US009353960B2

(12) United States Patent
Kim

(10) Patent No.: US 9,353,960 B2
(45) Date of Patent: May 31, 2016

(54) HUMIDIFIER

(71) Applicant: Hyung Joo Kim, Anseong-si (KR)

(72) Inventor: Hyung Joo Kim, Anseong-si (KR)

(73) Assignee: MERKER INC., Anseong-si (KR)

( * ) Notice: Subject to any disclaimer, the term of this patent is extended or adjusted under 35 U.S.C. 154(b) by 0 days.

(21) Appl. No.: 14/786,993

(22) PCT Filed: Jul. 28, 2014

(86) PCT No.: PCT/KR2014/006883

§ 371 (c)(1),
(2) Date: Oct. 26, 2015

(87) PCT Pub. No.: WO2015/012662

PCT Pub. Date: Jan. 29, 2015

(65) Prior Publication Data

US 2016/0123613 A1 May 5, 2016

(30) Foreign Application Priority Data

Jul. 26, 2013 (KR) ..... 10-2013-0088722
Feb. 19, 2014 (KR) ..... 10-2014-0019203

(51) Int. Cl.
*F24F 6/12* (2006.01)
*F24F 6/00* (2006.01)

(52) U.S. Cl.
CPC ..... *F24F 6/12* (2013.01); *F24F 2006/008* (2013.01)

(58) Field of Classification Search
CPC ..... F24F 6/00; F24F 6/06; F24F 6/12; F24F 7/06; F24F 2006/008
USPC ..... 261/81, DIG. 48
See application file for complete search history.

(56) References Cited

U.S. PATENT DOCUMENTS 2,382,681 A * 8/1945 Trier ..... B05B 7/0012 261/78.2
3,756,311 A * 9/1973 Bitz ..... F24F 6/06 165/60

(Continued)

FOREIGN PATENT DOCUMENTS

JP 2012-233687 11/2012
KR 20-1998-037423 8/1998

(Continued)

OTHER PUBLICATIONS

English Translation of 20-0360065, Oct. 2015.

(Continued)

*Primary Examiner* — Charles Bushey
*Assistant Examiner* — Scott Bushey
(74) *Attorney, Agent, or Firm* — KORUS Patent, LLC; Seong Il Jeong

(57) ABSTRACT

The present invention relates to a humidifier. According to an aspect of the present invention, there is provided a humidifier comprising: a main body including a water reservoir for storing water; an upper body disposed above the water reservoir for covering the water reservoir; and a vibration unit including a vibrator for atomizing the water in the water reservoir, wherein the upper body includes a first hinge part for hinge-coupling with the main body and a second hinge part for hinge-coupling with the vibration unit, the upper body is capable of being lifted from the main body using the first hinge part as a shaft, the vibration unit is capable of rotatably moving in the water using the second hinge part as a shaft, and the vibration unit further includes a vibrator receiving unit for the vibrator.

8 Claims, 4 Drawing Sheets

(56) References Cited

U.S. PATENT DOCUMENTS

| | | | | |
|---|---|---|---|---|
| 4,520,864 | A * | 6/1985 | Katagiri | F24F 1/02 165/60 |
| 5,278,937 | A * | 1/1994 | Alix | B64D 13/00 261/142 |
| 8,663,179 | B2 * | 3/2014 | Pelkus | A61H 9/0021 604/289 |
| 2008/0093750 | A1 * | 4/2008 | Wang | F24F 6/00 261/66 |

FOREIGN PATENT DOCUMENTS

| | | | |
|---|---|---|---|
| KR | 20-1998-023067 | | 3/1999 |
| KR | 20-0360065 | | 8/2004 |
| WO | WO2014/081069 | A1 * | 5/2014 |

OTHER PUBLICATIONS

English Translation of 20-1998-037423, Oct. 2015.
English Translation of 20-1998-023067, Oct. 2015.
English Translation of Abstract of 2012-233687, Oct. 2015.

* cited by examiner

HUMIDIFIER

CROSS-REFERENCE TO RELATED APPLICATION(S)

This application claims the benefit of International Application No. PCT/KR2014/006883, filed on Jul. 28, 2014, based on Korean Patent Application No. 10-2013-0088722, filed Jul. 26, 2013 and Korean Patent Application No. 10-2014-0019203, filed Feb. 19, 2014, the disclosures of which are hereby incorporated by reference herein in their entirety.

BACKGROUND

1. Technical Field

The present invention relates generally to a humidifier.

2. Description of the Related Art

A humidifier is a device for atomizing water and spraying the atomized water into the air to create a pleasant environment and a comfortable humidity for human health. The humidifier is also often used in order to relieve respiratory diseases caused by dry air.

Generally, ultrasonic humidifiers are widely used, and a conventional ultrasonic humidifier comprises, a water reservoir for storing water and a humidifier body which accommodates the water reservoir and includes an electric circuit. On a predetermined position of humidifier body is provided with a ultrasonic vibrator. Accordingly, when the water stored inside the reservoir is supplied on the ultrasonic vibrator, the ultrasonic vibrator atomizes the water to form a mist, and the mist is sprayed outside the humidifier.

After protracted use of the conventional ultrasonic humidifier, a bacteria or a mold and the like grow in the water reservoir, ultrasonic vibrator, etc., which causes the spraying of mist contaminated with the bacteria or mold. The only resolution for this problem is a frequent cleaning or sterilization of the water reservoir, ultrasonic vibrator, etc. However, the reservoir of the conventional ultrasonic humidifier has a shape to help accommodate the reservoir in the humidifier body (for example, a tank having only a small hole in the lower portion of the tank for water supply and so on). Therefore, there are several locations which are difficult for manual cleaning with hands. In addition, in the conventional ultrasonic humidifier, the ultrasonic vibrator is mostly coupled to the humidifier bed including an electric circuit, which makes it difficult to clean or sterilize.

In order to solve the specific problem associated with cleaning due to these factors, an ultrasonic humidifier having the ultrasonic vibrator disposed on the bottom surface of the reservoir instead of the humidifier body was developed and used. But, such an ultrasonic humidifier has a disadvantage in that only a small amount of water can be contained in the water reservoir at any time to allow placement of the ultrasonic vibrator close to the surface of the water for the ultrasonic humidifier to sufficiently atomize the water easily.

SUMMARY

It is an object of the present invention to solve the above-described problems of the conventional arts as a whole.

It is another object of the present invention to provide a humidifier easily cleanable by a user.

It is yet another object of the present invention to provide a humidifier capable of easily sterilizing all the parts that are in contact with water.

It is yet another object of the present invention to provide a humidifier capable of easily separating and sterilizing the parts that are in contact with water.

It is yet another object of the present invention to provide a humidifier with a low manufacturing cost while achieving all of the above objects.

The representative configuration of the present invention to achieve the above objects is as follows.

According to an aspect of the present invention, there is provided a humidifier comprising: a main body including a water reservoir for storing water; an upper body disposed above the water reservoir for covering the water reservoir; and a vibration unit including a vibrator for atomizing the water in the water reservoir, wherein the upper body includes a first lunge part for hinge-coupling with the main body and a second hinge part for hinge-coupling with the vibration unit, the upper body is capable of being lifted from the main body using the first hinge part as a shaft, the vibration unit is capable of rotatably moving in the water using the second hinge part as a shaft, and the vibration unit further includes a vibrator receiving unit for the vibrator.

In addition, other configurations may be provided according to the technical idea of the present invention.

According to the present invention, there is provided a humidifier which can be easily cleaned and sterilized by a user.

According to the present invention, there is provided a humidifier in which the parts contacted with water can be easily separated and sterilized.

Also, according to the present invention, there is provided a humidifier with a low manufacturing cost while achieving all of the above objects.

DETAILED DESCRIPTION

Figure 1:
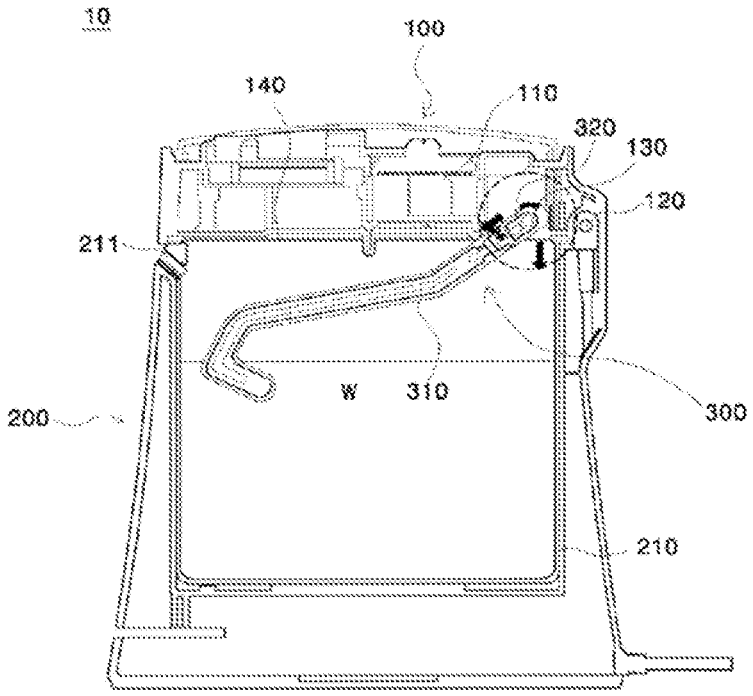
FIG. 1 shows an overall configuration of a humidifier according to an embodiment of the present invention.

The following detailed description of the present invention is made with reference to accompanying drawings illustrating specific embodiments of the present invention. These embodiments are described in detail to the extent that it is sufficient for a person skilled in the art to practice the present invention. Although embodiments of the present invention are different from each other, it should be understood that these are not necessarily exclusive to each other. For example, specific shapes, structures and characteristics as described herein can be practiced by modifying one embodiment to another without departing from the spirit and scope of the present invention. Further, it is to be understood that locations and configurations of the individual components of the embodiments can be modified without departing from the spirit and scope of the present invention. Accordingly, the following detailed description is intended to be non-limitative, and the scope of the present invention should be taken to encompass the scope of the appended claims and their equivalents. Similar reference numerals in the drawings represent the same or similar components in various aspects.

In the following, to allow those skilled in the art to easily practice the present invention, several preferred embodiments of the present invention will be described in detail with reference to the accompanying drawings.

Preferred Embodiments of the Present Invention

FIG. 1 shows an overall configuration of a humidifier according to an embodiment of the present invention. Referring to FIG. 1, a humidifier 10 comprises an upper body 100, a main body 200 and a vibration unit 300.

According to an embodiment of the present invention, the upper body 100 may include a prescribed electric circuit (not shown) for the humidifier therein, and may further include a fan 110, a first hinge part 120, a second hinge part 130 and a separating plate 140. The upper body 100 can be disposed over a water reservoir 210 of the main body 200 to be described later, if desired, thereby covering it.

The electric circuit of the upper body 100 may be used to start or stop the vibration of a vibrator in the vibration unit 300 to atomize water (W) in the water reservoir 210. Also, the electric circuit may control the fan 110 to rotate as well when the vibrator is vibrating. The control state of the electric circuit can be determined by an operation state of a switch (not shown) attachable to the upper body 100, main body 200 and so on. The other structure of the electric circuit may be similar to that of the electric circuit of the conventional ultrasonic humidifier. In the meantime, it may be preferable that the electric circuit is included in the upper body 100; however, it can be included in the main body 200, if needed.

The fan 110 can rotate to intake external air into the water reservoir 210 and spray it to the outside of the water reservoir 210 (i.e. the outside of the humidifier 10) while including a mist generated in the water reservoir 210, in addition, a filter not shown) associated with the fan 110 can be disposed. The filter can purify the external air provided into the water reservoir 210. Meanwhile, the fan 110 may be preferably included in the upper body 100; however, it can be included in the main body 200, if needed.

The first hinge part 120 may be a component for hinge-coupling the upper body 100 and the main body 200. Accordingly, a user can lift up the upper body 100 from the main body 200 using the first hinge part 120 as a shaft. If the upper body 100 is lifted up from the main body 200, the vibration unit 300, which may be directly coupled to the upper body 100, can be lifted up together with the upper body 100 as it will be described in detail later. Such a structure allows a user to easily take out the water reservoir 210 from the main body 200 without separating the vibration unit 300.

The second hinge part 130 may be a component for hinge-coupling the upper body 100 and the vibration unit 300. Accordingly, the vibration unit 300 can move upward or downward while rotating in the water in the water reservoir 210 using the second hinge part 130 as a shaft according to the water level. The movement of the vibration unit 300 will later be described in more detail.

A variable resistance (not shown) can be included in the second hinge part 130. The variable resistance may be configured to vary its resistance in accordance with the angle of the vibration unit 300 at the second hinge part 130. Accordingly, the gradient of the vibration unit 300 or the height of the vibrator (312 in FIG. 3) in the vibration unit 300 in the water reservoir 210 (which approximates the water level in the water reservoir 210) can be calculated based on the resistance value of the variable resistance, and the electric circuit may inform the user of the timing of the water replenishment with reference to it. This information may be especially useful when the main body 200 or the water reservoir 210 is made of an opaque material. The case in which the variable resistance is used to check the water level is illustrated herein, but the present invention is not limited thereto. It is possible to also use a water level sensor of the vibration unit 300 or the like as will be described later.

The separating plate 140 serves as a bottom plate of the upper body 100 to cover the electric circuit in the upper body 100 and protect it from the mist generated from the water in reservoir 210. The separating plate 140 is exposed to the mist at any time, it should be cleaned/sterilized frequently. Accordingly, it is preferable that the separating plate 140 is configured to be separable from the upper body 100 so that it is cleaned or sterilized separately. Also, the separating plate 140 is preferably made of a heat-resistant material such as metal or glass (for example, stainless steel) which can facilitate cleaning or sterilization.

According to an embodiment of the present invention, the main body 200 is the main portion of the humidifier 10, which may include the water reservoir 210 for storing water therein and for providing a space required for the stored water to become a mist by the vibrator. The water reservoir 210 has a shape in which the upper part thereof is wide and open to make it easy to clean and does not have electrical components which would not allow any contact with the water. So, the user can wash the water reservoir 210 everywhere here and even boil water with it. In this case, the water reservoir 210 can be separated with and taken out from the main body 200, if needed. On one side of the water reservoir 210, a mist outlet 211 may be formed, which discharges the mist in the water reservoir 210 to the outside. The user can fill the water reservoir 210 with water and heat the water reservoir 210 to boil the water in order to sterilize the water reservoir 210. To this end, the water reservoir 210 is preferably made of a heat-resistant material such as metal or glass (for example, stainless steel) which can facilitate cleaning or sterilization.

Figure 7:
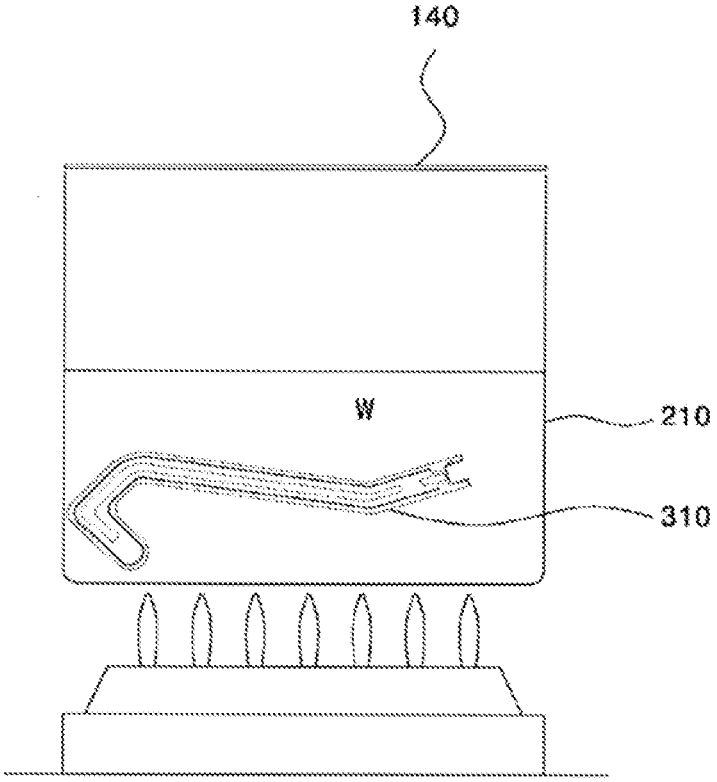
FIG. 7 is a reference diagram regarding a situation where the water reservoir, the lower part of the vibration unit and the separating plate are being sterilized.

On the other hand, a heat generation unit (not shown) may be further included under the water reservoir 210 to directly boil the water in the water reservoir 210. The heat generation unit is made of coils and the like and generates heat when supplied with electricity to heat the water in the water reservoir 210. The electric circuit can cooperate with a separate switch (not shown) for an operation of the heat generation unit. But, in the case where the water reservoir 210 can be separated from the main body 200 and handled separately, the user can sterilize the water reservoir 210 by simply boiling the water filled inside the water reservoir 210 using a household burner and the like. FIG. 7 is a reference diagram illustrating such a situation. As shown in FIG. 7, the water reservoir 210 can be sterilized together with the separating plate 140 and the lower part 310 of the vibration unit 300, which will be described later.

According to an embodiment of the present invention, the vibration unit 300 is disposed for the water stored in the water reservoir 210 and performs a function of creating an oscillation in the water to atomize it. The vibration unit 300 may include a lower part 310 and an upper part 320. The lower part 310 can include or accommodate the vibrator (312 of FIG. 3) for vibrating the water, and the upper part 320 is coupled to the second hinge part 130 to suspend the vibration unit 300 to float on the water as a whole while supporting the lower part 310. Meanwhile, the vibration unit 300, especially the lower part 310, may further include a water level sensor (not shown) to inform the user about whether the water is required to be replenished by detecting water at a predetermined location. The water level sensor can provide a prescribed electric signal to the above-described electric circuit to perform a function of start and stop the vibration of the vibrator 312. That is, a control function that starts the vibration of the vibrator 312 if water is detected and stops the vibration of the vibrator 312 if water is not detected may be performed.

Figure 2:
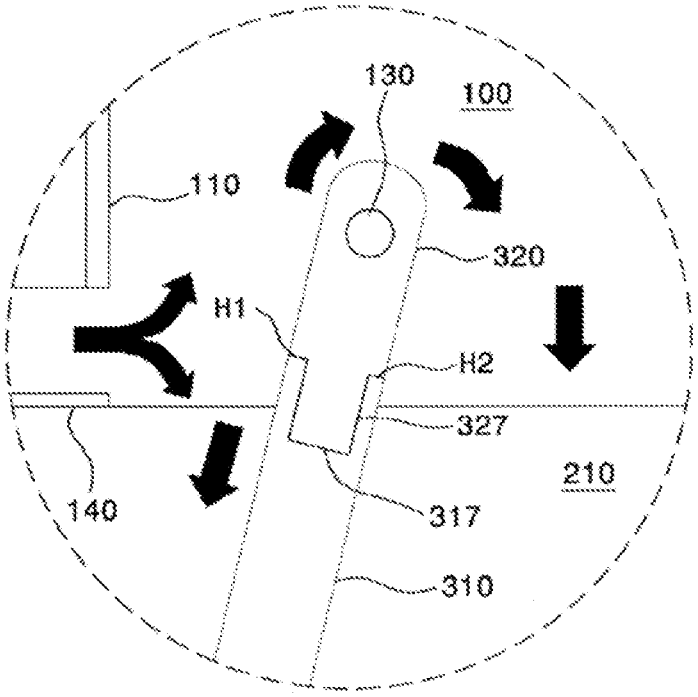
FIG. 2 is a schematic diagram showing a coupling state of the upper body and the vibration unit according to an embodiment of the present invention.

In the following, a coupling state of the upper body 100 and the upper part 320 of the vibration unit 300 is described referring to FIGS. 1 and 2. In FIG. 1, the arrow indicates a flowing route of the external air incoming via the fan 110. FIG. 2 is a schematic diagram showing a coupling state of the upper body and the upper part of the vibration unit according to an embodiment of the present invention.

As shown, the upper part 320 of the vibration, unit 300 can be coupled to the predetermined position of the upper body 110 through the intermediation of the second hinge part 130. The position is preferably on the incoming route of the external air indicated by the arrow. While it is important for the vibration unit 300 to be hinge-coupled to the upper body 100 in the present invention, the hinge-coupling part of the second hinge part 130 and so on are the parts in which cleaning or sterilization is relatively difficult compared to the part of the separating plate 140 of the upper body 100. Accordingly, it is preferable to locate it on the incoming route of the external air for the incoming external air to block the approach of the mist to the second hinge part 130 and so on in some degree.

In the same context, as shown in FIG. 2, it is preferable that the vibration unit 300 has a structure that the protrusion 327 of the upper part 320 thereof is inserted to the groove 317 of the lower part 310 thereof to be combined with each other. Such a configuration helps the user clean the upper part 320 of the vibration unit 300 which is difficult to separate and sterilize by minimizing the indented portions. In the meantime, it is preferable that H1 or H2 part of the upper part 320 as shown is sufficiently and constantly apart from the water in the water reservoir 210 by the support of the second hinge part 130.

On the other hand, by hinge-coupling the vibration unit 300 to the upper body 100 through the intermediation of the second hinge part 130, and preventing the second hinge part 130 from being dropped down under the vibration unit 300, due to the upward directional torque in the vibration unit 300 resulting from the auxiliary operation of the hinge or the frictional force at the hinge, the size of the portion of the vibration unit 300 which is submerged in the water (for example, a vibrator receiving unit (311 of FIG. 3) of the vibration unit 300 which will be described later) can kept as small as possible.

Figure 3:
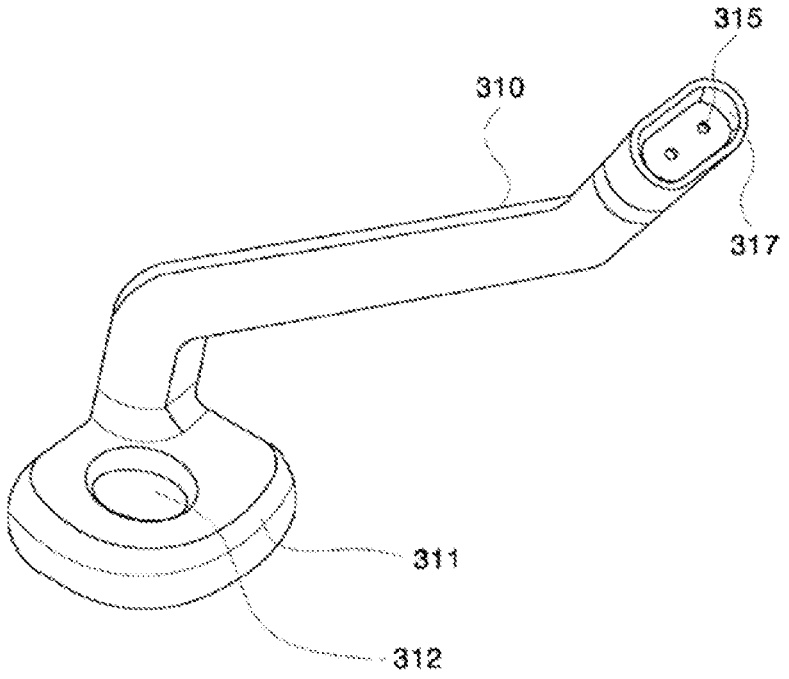
FIG. 3 shows a lower part of the vibration unit according to an embodiment of the present invention.

Now, the lower part 310 of the vibration unit 300 is described referring to FIG. 3. FIG. 3 shows the lower part of the vibration unit according to an embodiment of the present invention.

As shown, the lower part 310 may include a vibrator receiving unit 311 and a vibrator 312 on one side thereof. The vibrator receiving unit 311 may be for a temporary or non-temporary placement of the vibrator 312, or it can be combined with the vibrator 312. The vibrator receiving unit 311 may have a structure (for example, a structure that is hollow inside) or a material (for example, a material having a lower density than water) with buoyancy in water. On the other hand, the vibrator 312 can be any one of the types of conventional ultrasound vibrators. The vibrator 312 may start or stop the vibration in accordance with the electric signal received from the electric circuit of the upper body 100 through the wiring (not shown) inside the lower part 310 and the upper part 320.

The lower part 310 may include at least one terminal 315 on the other side thereof. And, an electrical connection means (not shown) corresponding to the terminal 315 may be formed at a portion of the upper part 320 coupled to the lower part 310. The terminal 315 or the electrical connection means may be connected to the wiring (not shown) inside the lower part 310 and the upper part 320 as described above.

Furthermore, in order to make the lower part 310 and the upper part 320 detachable from each other, the lower part 310 and the upper part (320) may include materials with magnetic force for the coupling portion with each other, or include a coupling structure by the frictional force such as protrusions and grooves.

The lower part 310 of the vibration unit 300 can be boiled in water in the same manner as the separating plate 140 and the like, if well packaged, due to the simple electrical structure.

Importantly, the vibrator receiving unit 311 can be formed to be bent from the bottom part 310 to the position where the vibration unit 300 is coupled to the upper body 100 (that is, the position of the second hinge part 130), as shown. This configuration is very advantageous for preventing the vibrator 312 from exposure to the water during the flotation of the vibration unit 300 due to the buoyancy when containing a large amount of water in the water reservoir 210 (the vibrator 312 should be submerged in the water while it is vibrating and it is preferable that the vibrator 312 is submerged in the water even while it is not vibrating).

Figure 4:
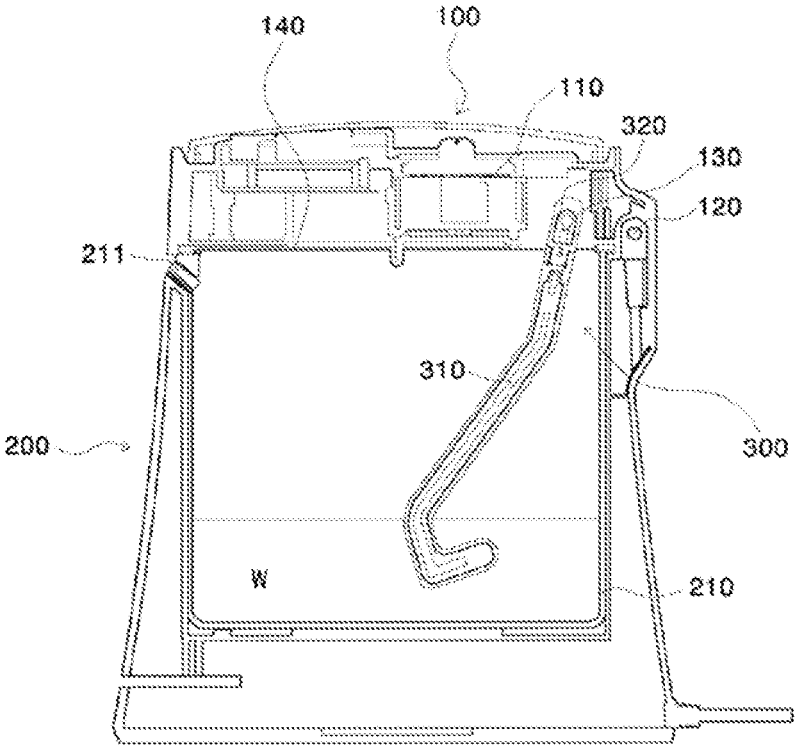
FIG. 4 shows a location of the vibration unit when containing a small amount of in water in the water reservoir.
Figure 5:
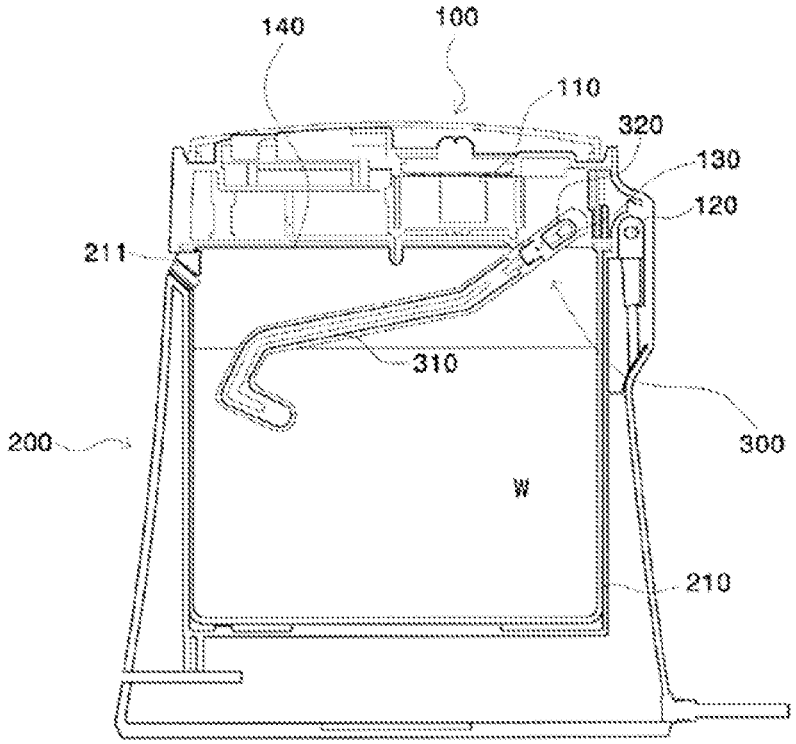
FIG. 5 shows a location of the vibration unit when containing a large amount of water in the water reservoir.

FIG. 4 shows a location of the vibration unit when containing a small amount of water in the water reservoir, and FIG. 5 shows a location of the vibration unit when containing a large amount of water in the water reservoir.

As shown in FIGS. 4 and 5, in either case that a small or large amount of water is contained in the water reservoir 210, due to the specific structure of the lower part 310 of the vibration unit 300 according to the present invention, the vibrator receiving unit 311 is disposed under the water surface and the vibrator 312 can atomize water.

Figure 6:
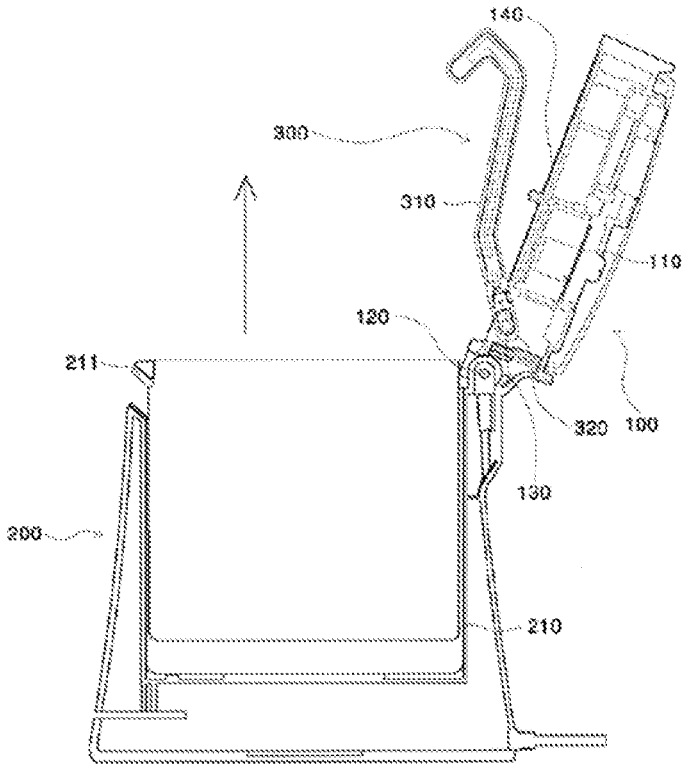
FIG. 6 is a diagram showing a state where the upper body is lifted up from the main body according to an embodiment of the present invention.

FIG. 6 is a diagram showing a state where the upper body is lifted up from the main body in accordance with an embodiment of the present invention.

When a user lifts up the upper body 100 from the main body 200, the vibration unit 300 coupled to the tipper body 100 is lifted from the main body 200 as well. Accordingly, when the user supplies the water reservoir 210 with water or cleans or sterilizes the water reservoir 210, the user does not need to separate the vibration unit 300. Furthermore, the above characteristics serve the convenience of separating the water reservoir 210 easily from the main body 200 in the direction of the arrow and handling it comfortably.

While there has been described herein the present invention with reference to the specific components, embodiments, and drawings, it will be appreciated by those skilled in the art that they are only intended to aid the overall understanding of the present invention, not to limit the present invention to those embodiments, and that various changes and modifications may be made to the invention in view of the above description.

Accordingly, the idea of the present invention should not be limited to the embodiments described above, and it is intended that the present invention encompass the appended claims and the equivalents and modifications thereof as well.

What is claimed is:

1. A humidifier which comprises:

a main body including a water reservoir for storing water;

an upper body disposed above the water reservoir for covering the water reservoir;

a vibration unit including a vibrator for atomizing the water in the water reservoir; and a hinge part for hinge-coupling of the vibration unit, wherein the vibration unit is capable of rotatably moving in the water using the hinge part as a shaft, and the vibration unit further includes a vibrator receiving unit for the vibrator.

2. The humidifier of claim 1, wherein the upper body includes another hinge part for hinge-coupling with the main body and the upper body is capable of being lifted from the main body using the other hinge part as a shaft.

3. The humidifier of claim 2, wherein the vibrator receiving unit has a bent shape in a direction from a bottom part of the vibration unit to the hinge part.

4. The humidifier of claim 2, wherein the upper body further includes a fan for intake of external air into the water reservoir and the hinge part is disposed on an incoming route of the external air from the fan.

5. The humidifier of claim 2, wherein the hinge part includes a variable resistance whose resistance is configured to vary according to an angle of the vibration unit at the hinge part.

6. The humidifier of claim 2, wherein the vibration unit further includes a water level sensor.

7. The humidifier of claim 2, wherein the vibration unit includes an upper part and a lower part, the upper part is coupled to the hinge part, the lower part includes the vibrator receiving unit, and the upper part and the lower part are detachable from each other.

8. The humidifier of claim 2, further comprising a heat generation unit under the water reservoir.

* * * * *